US007510188B2

(12) United States Patent
Yang et al.

(10) Patent No.: US 7,510,188 B2
(45) Date of Patent: Mar. 31, 2009

(54) BA-GUA FORTUNE TELLING GAME TOWER

(76) Inventors: Ju-Hsun Yang, No. 807, Jiancheng Rd., East Dist., Taichung (TW); Fu-Bin Lin, No. 807, Jiancheng Rd., East Dist., Taichung (TW)

( * ) Notice: Subject to any disclaimer, the term of this patent is extended or adjusted under 35 U.S.C. 154(b) by 164 days.

(21) Appl. No.: 11/621,172

(22) Filed: Jan. 9, 2007

(65) Prior Publication Data

US 2008/0164655 A1 Jul. 10, 2008

(51) Int. Cl.
*A63F 7/00* (2006.01)

(52) U.S. Cl. ..... 273/161; 273/142 HA; 273/142 E; 273/123 R

(58) Field of Classification Search ..... 273/161, 273/153 R, 155, 142 H, 142 HA, 142 E, 142 F, 273/142 G, 123 R
See application file for complete search history.

(56) References Cited

U.S. PATENT DOCUMENTS 1,977,814 A * 10/1934 Warner ..... 273/110
3,841,637 A * 10/1974 Piazza et al. ..... 273/142 R
4,163,556 A * 8/1979 Bertin ..... 273/142 HA
4,376,537 A * 3/1983 Yokoi ..... 273/113
4,772,240 A * 9/1988 Boskovic ..... 273/109
5,102,135 A * 4/1992 Addiechi ..... 273/142 HA
5,451,055 A * 9/1995 Lo ..... 273/113
5,549,295 A * 8/1996 Goldring ..... 273/118 R

* cited by examiner

*Primary Examiner*—Steven Wong
(74) *Attorney, Agent, or Firm*—Rabin & Berdo, P.C.

(57) ABSTRACT

A Ba-Gua game tower includes a main disk and at least one secondary disk attached to the bottom of the main disk. The main disk has a disk body with a top face divided into eight divinatory sections respectively designated with a Chinese character. The secondary disk has a secondary disk body with a top face divided into portions respectively designated with a numeral from 1-6 such that there are multiple sets of numerals on the top face of the secondary disk body. A first ball is able to roll on the top face of the disk body and a second ball is able to roll on the top face of the secondary disk body to respectively indicate where a player should look up in a reference book.

7 Claims, 10 Drawing Sheets

BA-GUA FORTUNE TELLING GAME TOWER

BACKGROUND OF THE INVENTION

1. Field of the Invention

The present invention relates to a fortune telling game tower, and more particularly to a Ba-Gua (Eight-trigram) fortune telling game tower for self-divination and home entertainment.

2. Description of the Prior Art

Yi-Jing (The Book of Changes) and Ba-Gua (Eight-trigram) are both ancient Chinese heritage. Yi-Jing, Ba-Gua is related to two (Yi) divinations evolving to four (Xiang) divinations, four (Xiang) divinations to eight (Fang) divinations, eight (Fang) divinations to sixteen (Xing) divinations, sixteen (Xing) divinations to twenty-four (Jie) divinations, twenty-four (Jie) divinations to thirty-two (Qi氣) divinations, thirty-two (Qi氣) divinations to forty (Wei) divinations, forty (Wei) divinations to forty-eight (Zhu) divinations, forty-eight (Zhu) divinations to fifty-six (Chi奇) divinations and fifty-six (Chi奇) divinations to sixty-four (Cheng) divinations. The mysterious principles of Yi-Jing and Ba-Gua tell the Yin-Yang (Moon & Sun) of the Chinese mythology and the eternal recycle of all forms. Yi-Jing and Ba-Gua is the most commonly used method in augury. However, the knowledge involved is so profound and so vast that no one is able to grasp the essence of it within a short period of time. There is no shortcut to learning to master and interpret symbols of Yi-Jing and Ba-Gua. An expert is needed when interpretation of divinatory symbols is required, which is quite troublesome and annoyed.

To overcome the shortcomings, the present invention tends to provide an improved Ba-Gua fortune telling game tower to mitigate the aforementioned problems.

SUMMARY OF THE INVENTION

The primary objective of the present invention is to provide a Ba-Gua fortune telling game tower to allow the player to easily grasp the meaning of the divinatory symbols shown from the tower of the present invention. The principle of the game tower is entirely based on forty-eight primary divinations of Yi-Jing Chi-Men (Mysterious Gate). That is, the divinations of the game tower of the present invention are composed of a main disk and multiple secondary disks. The main disk has eight primary divinatory sections, i.e. Qian, Dui, Li, Zhen, Kun, Gen, Kan and Xun and a ball rotatably received in the main disk and randomly rested in one of the eight divinatory sections. Each of the secondary disks is divided into multiple sections respectively designated with a numeral from 1-6. Therefore, the player is able to tell first from the divinatory sections of the main disk in which the ball rested in association with the numeral indicated by the secondary ball in one of the secondary disks of the result of the divination.

Because the process of the tower game is simple, everyone is eligible to play even though the player has no knowledge in ancient Chinese Ba-Gua and Yi-Jing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
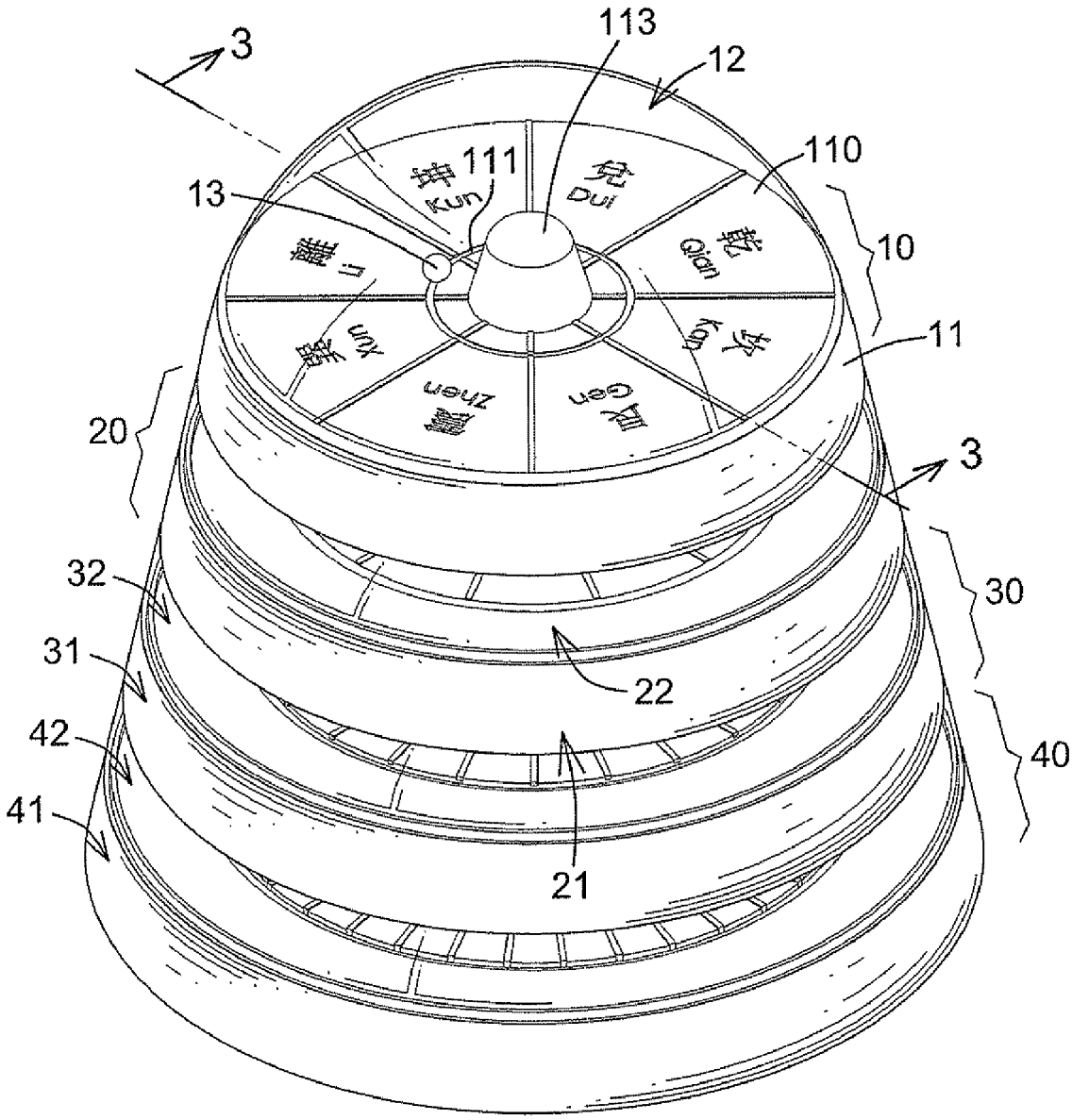
FIG. 1 is a perspective view of the Ba-Gua fortune telling game tower of the present invention.
Figure 2:
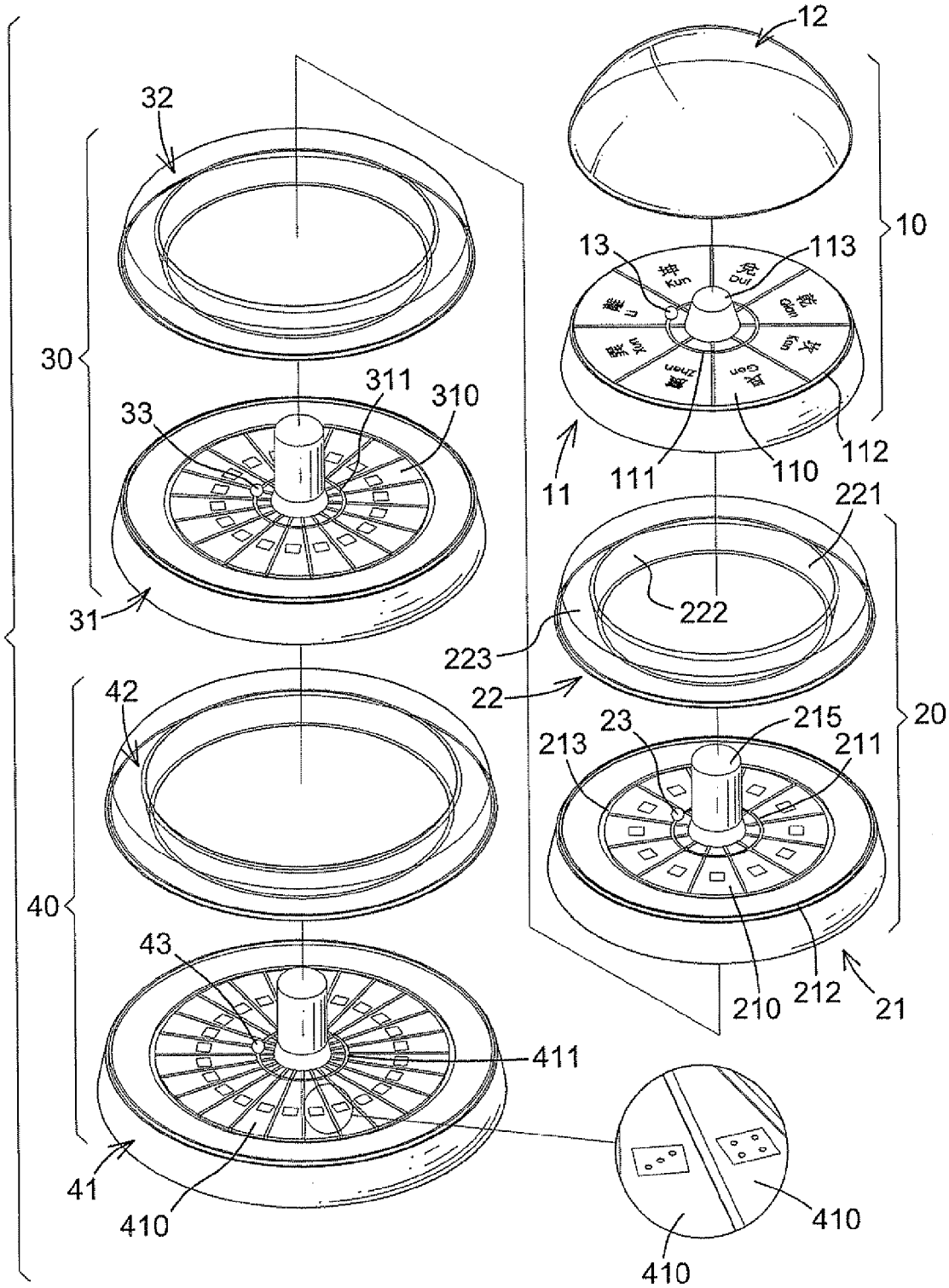
FIG. 2 is an exploded perspective view of the Ba-Gua fortune telling game tower in FIG. 1.
Figure 3:
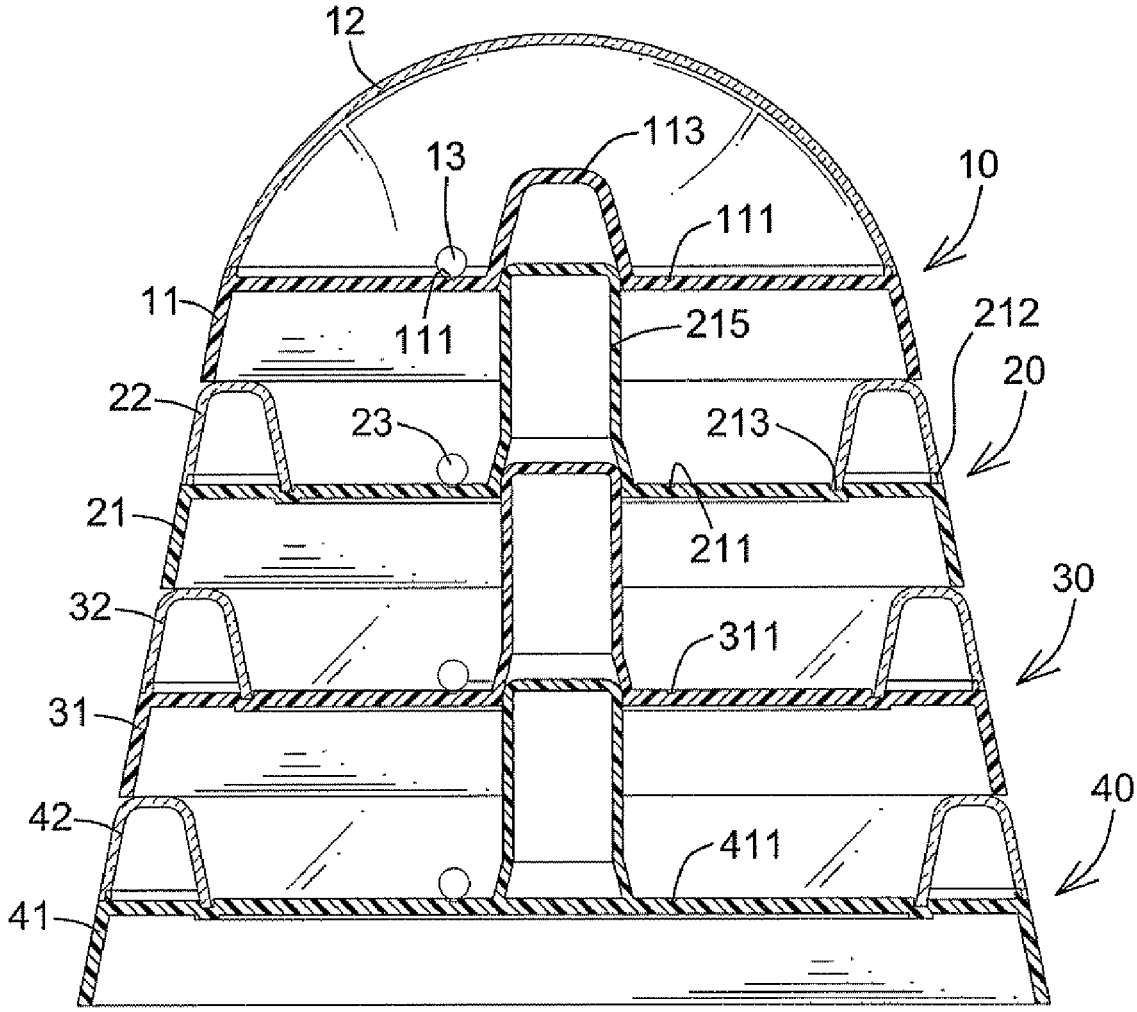
FIG. 3 is a cross sectional view taken from line 3-3 in the game tower in FIG. 1.
Figure 4:
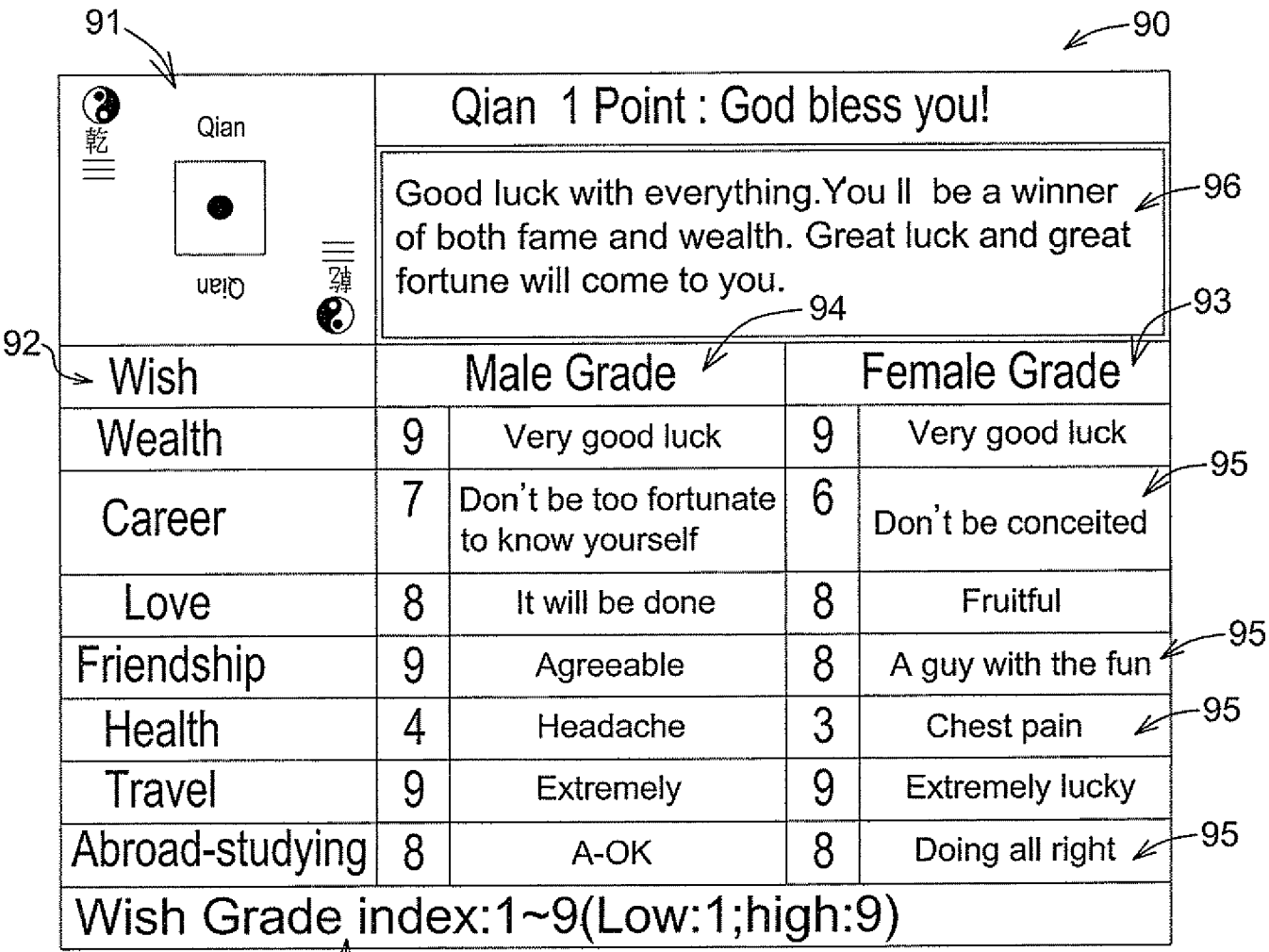
FIGS. 4 to 7 are top plan views showing example pages of the reference book associated with the game towers of the present invention.
Figure 5:
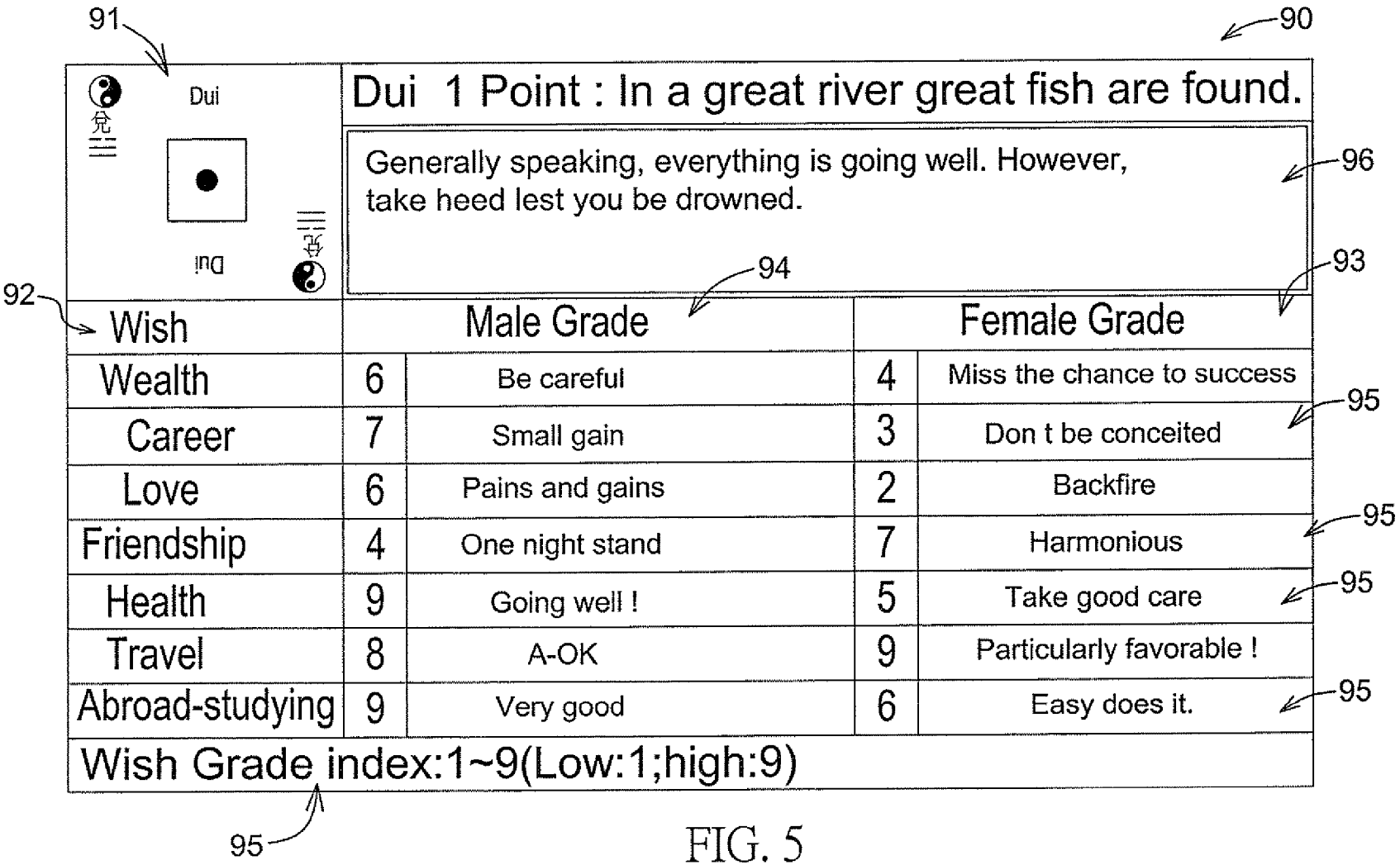
Figure 6:
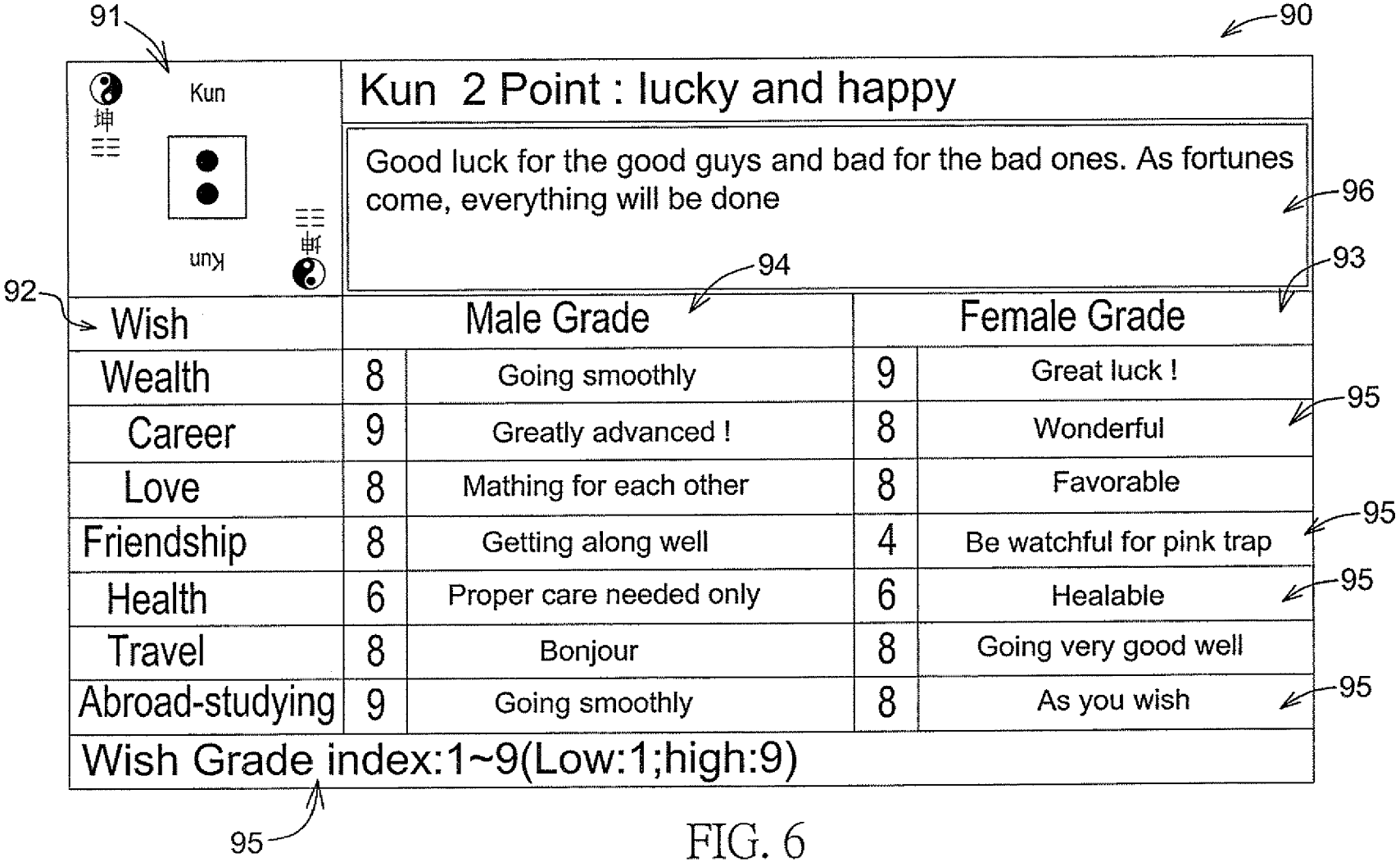
Figure 7:
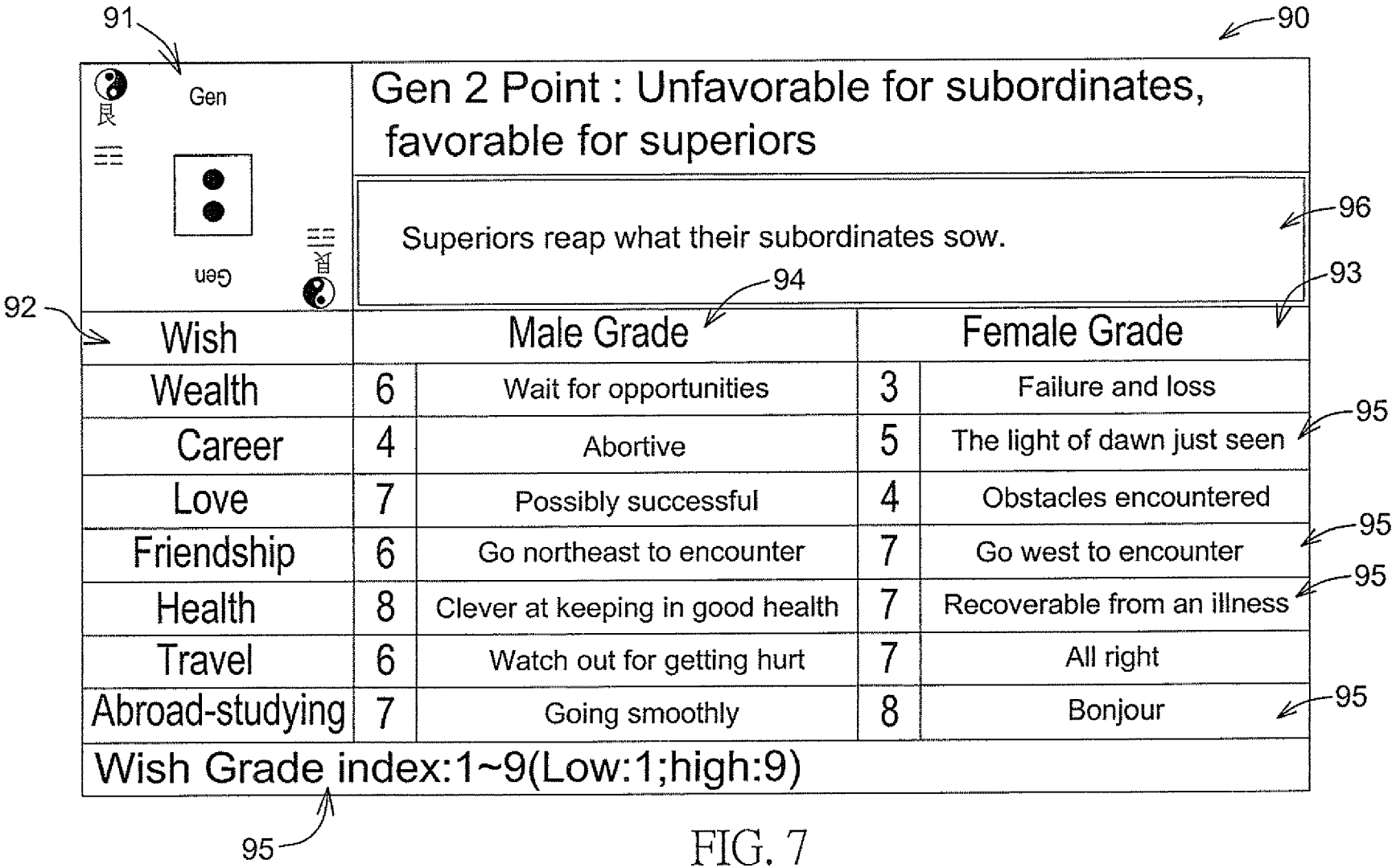

With reference to FIGS. 1-3, the fortune telling game tower in accordance with the present invention is composed of a main disk (10), a first secondary disk (20), a second secondary disk (30) and a third secondary disk (40).

The main disk (10) includes a disk body (11) and a transparent main dome (12). The disk body (11) has a top face divided into eight divinatory sections (110) respectively provided with a Chinese character of Qian (乾), Dui (兌), Li(離), Zhen(震), Kun(坤), Gen (艮), Kan(坎) and Xun(巽), an inner annular groove (111) defined in the top face and passing through the eight divinatory sections (110), an outer annular groove (112) defined in an outer periphery of the top face to sandwich the divinatory sections (110) with the inner annular groove (111) and a hollow cap (113) formed on a center of the top face. A bottom periphery of the transparent main dome (12) is received in the outer annular groove (112) to isolate the divinatory sections (110). A first ball (13) is able to roll on the inner annular groove (111) and is enclosed inside the transparent main dome (12). Therefore, after the transparent main dome (12) is on top of the top face of the disk body (11), the first ball (13) is able to move around each of the divinatory sections (110) along the annular inner groove (111) and rest on one of the divinatory sections (110).

In the preferred embodiment, there are three secondary disks, namely the first secondary disk (20), the second secondary disk (30) and the third secondary disk (40).

The first secondary disk (20) is composed of a first secondary disk body (21) and a transparent first secondary cover (22). The first secondary disk body (21) has a top face divided into twelve portions (210) respectively designated with a numeral from 1 to 6 (1-6) such that there are two sets of numerals of 1-6 on the top face of the first secondary disk body (21) to fill the twelve portions (210), a first inner annular groove (211) on the top face, a first outer annular groove (212) defined along an outer periphery of the top face of the first secondary disk body (21) and a mediate annular groove (213) defined in the top face and between the first outer annular groove (212) and the first inner annular groove (211). A first connection rod (215) is centrally formed on the top face of the first secondary disk body (21) to extend through a bottom face of the disk body (11) of the main disk (10) and into the hollow cap (113) to combine the first secondary disk (20) and the main disk (10). A second ball (23) is able to roll along the first inner annular groove (211) and rest on a corresponding one of the portions (210). The transparent first secondary cover (22) is composed of an outer wall (221) corresponding to the first outer annular groove (212), an inner wall (222) corresponding to the mediate annular groove (213) and an annular plate (223) interconnecting a top periphery of the outer wall (221) and the inner wall (222). Thus after the second ball (23) is placed on the first inner annular groove (211) of the first secondary disk (20) to allow the second ball (23) to move along the first inner annular groove (211), a bottom periphery of the outer wall (221) is able to be received in the first outer annular groove (212) and a bottom periphery of the inner wall (222) is able to be received in the mediate annular groove (213) to entirely prevent interference from outside the first secondary disk (20) to the second ball (23).

The second secondary disk (30) and the third secondary disk (40) respectively have a second secondary disk body (31), a third secondary disk body (41), a transparent second secondary cover (32), a transparent third secondary cover (42), a third ball (33), able to roll on a second inner annular groove (311) on the second secondary disk body (31) and a fourth ball (43) able to roll on a third inner annular groove (411) on the third secondary disk body (41). The second secondary disk body (31) has a top face divided into eighteen portions (310) and the third secondary disk body (41) has a top face divided into twenty-four portions (410). When compared with the structure with the first secondary disk (20), it is noted that the second secondary disk (30) and the third secondary disk (40) each has a structure the same as that of the first secondary disk (20). Thus further details of the structure of the second secondary disk (30) and the third secondary disk (40) are omitted. However, the function and the structure of the second secondary disk (30) and the third secondary disk (40) maybe understood by reference to the structure and function of the first secondary disk (20). According to the eighteen portions (310) on the top face of the second secondary disk (30) and twenty-four portions (410) on the top face of the third secondary disk (40), there are three sets of numerals from 1 to 6 on the second secondary disk (30) and there are four sets of numerals from 1 to 6 on the top face of the third secondary disk (40).

A third ball (33) and a fourth ball (43) are respectively able to roll on the third inner annular groove (311) and on the fourth inner annular groove (411). It is noted that the first secondary disk body (21) has twelve portions (210), the second secondary disk body (31) has eighteen portions (310) and the third secondary disk body (41) has twenty-four portions (410). Accordingly, the first secondary disk (20) (with twelve portions) is able to divine wedding, love affairs, friendship, . . . etc., the second secondary disk (30) (with eighteen portions) is able to divine healthy, travelling . . . etc., and the third secondary disk (40) (with twenty four portions) is able to divine fortune and business.

When the game tower of the present invention is played, the player(s) shakes the entire game tower to allow the balls (13,23,33,43) to roll along the inner annular groove (111,211, 311,411). After the balls (13,23,33,43) are stopped on the top faces of the disk bodies (11,21,31,41), the player may observe the position of the ball (13) to determine which divinatory section (110) he/she should look up in a reference book (90), as shown in FIGS. 4 to 7. For example, if the player wishes to know his/her love affairs, the player should check the position of the second ball (23) and if the player wishes to know his/her fortune, the player should check the position of the fourth ball (43).

With reference to FIGS. 4-7, a reference book (90) is shown and composed of forty-eight pages. Each page of the reference book (90) includes a divinatory symbol column (91) to correspond to one of the eight Chinese characters on the divinatory sections (110), a interpretation column (96), a wishing column (92) located under the divinatory symbol column (91), a female index column (93) and a male index column (94) both located under the interpretation column (96) and an index description column (95). The wishing column (92) includes a fortune column, a business column, a love affair column, a friendship column, a health column, a travelling column, a schooling column and a wishing index column. The intersection of either the male index column (94) or the female index column (93) and the wishing column (92) represents the index description column (95). Because a same divinatory symbol has different meanings when referring to male and female, the female index column (93) and the male index column (94) are presented for different gender of the player.

Suppose a player is playing the game tower and the player wishes to know his/her fate in the business, the first ball (13) stops at the Qian (乾) section (110) and the fourth ball (43) stops at numeral one (1), the player looks up the reference book (90) for the divination interpretation. If the player is a female player, she gets an index of six supposing business is her wish to know during the divination, whereas the result is "don't be conceited". If wish to know during the divination, whereas the result is "don't be too fortunate to know yourself".

Figure 8:
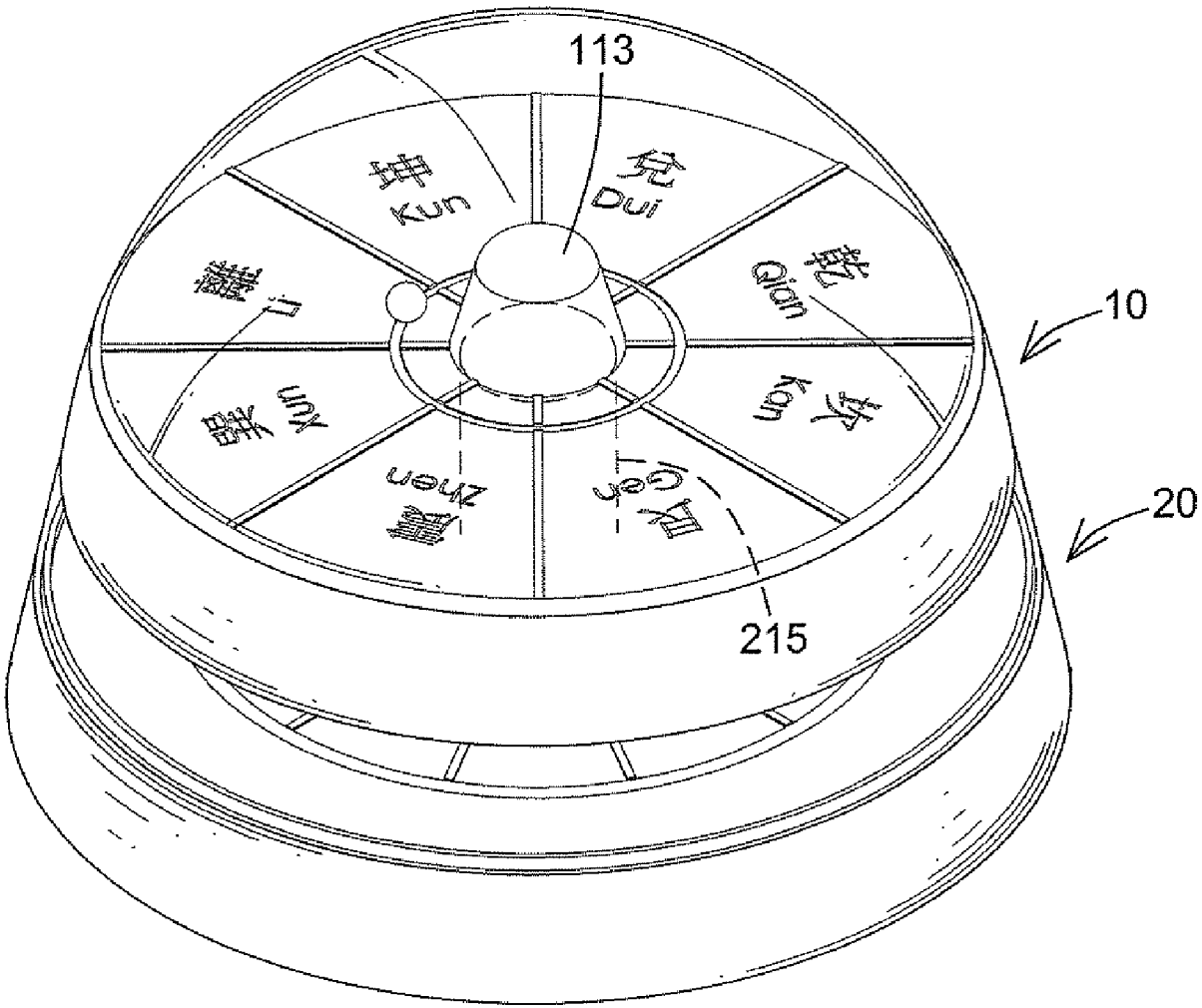
FIG. 8 is a perspective view showing the combination of the main disk and the first secondary disk.
Figure 9:
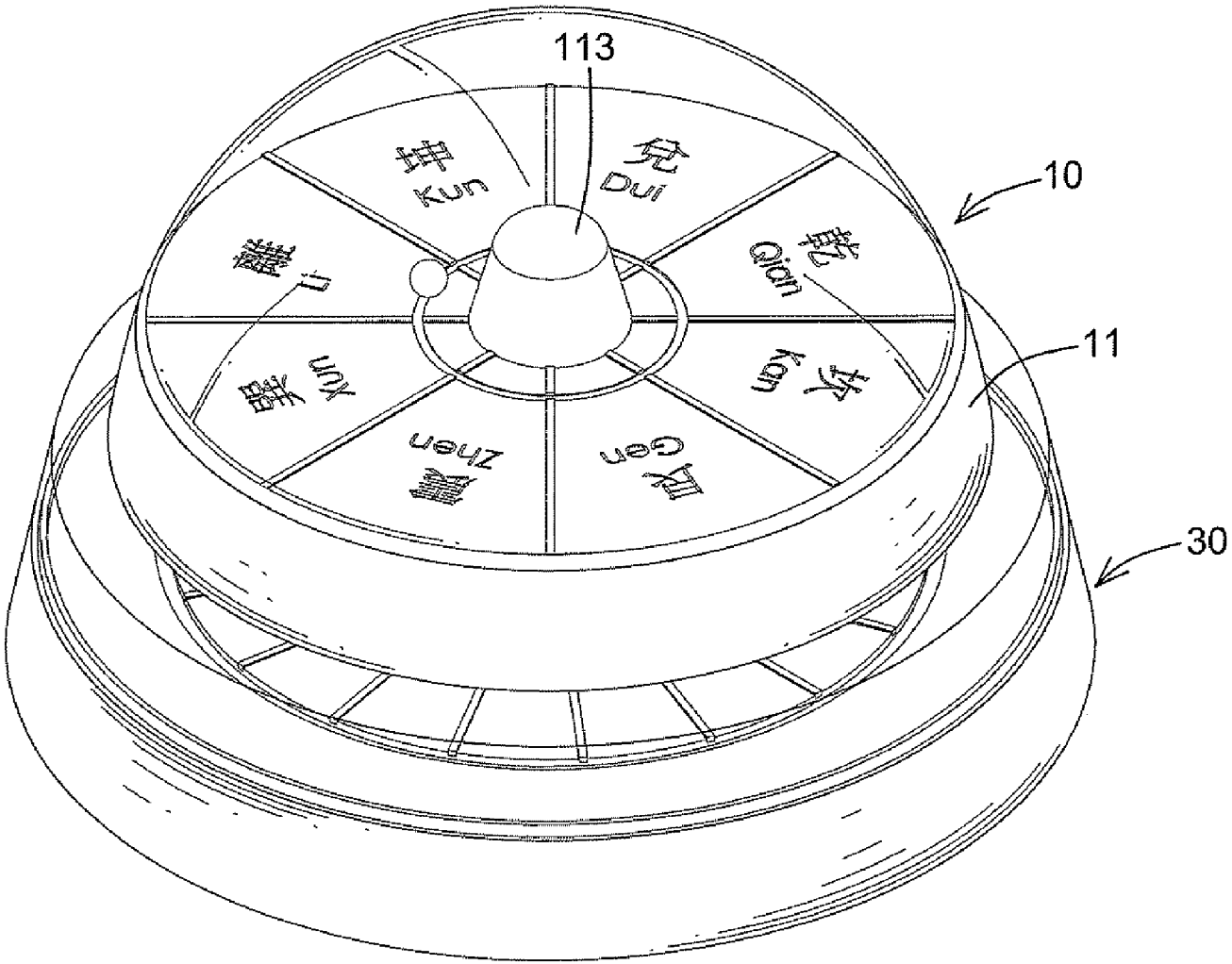
FIG. 9 is a perspective view showing the combination of the main disk and the second secondary disk.
Figure 10:
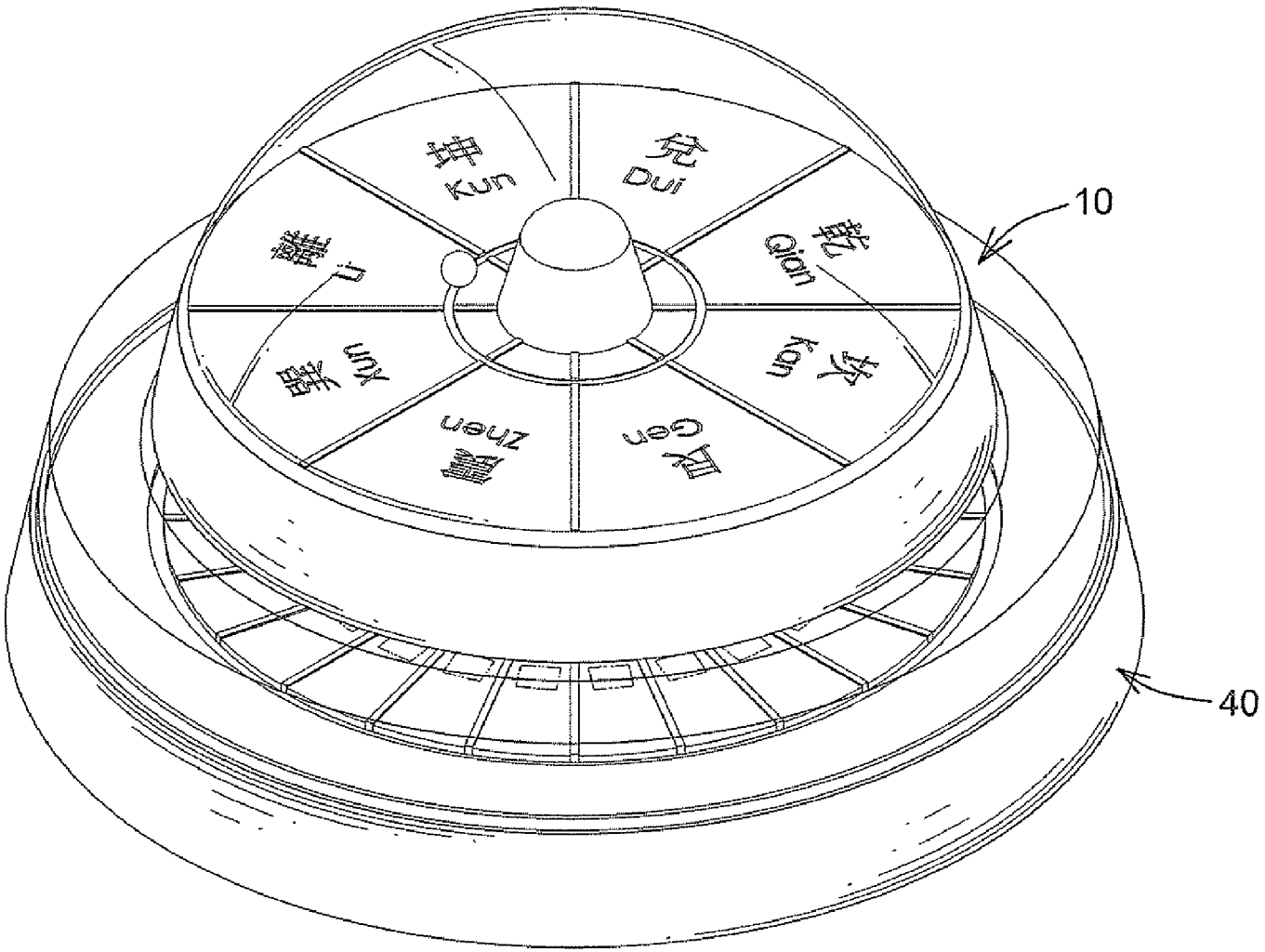
FIG. 10 is a perspective view showing the combination of the main disk and the third secondary disk.

In the depiction of FIGS. 1-3, it is noted that the main disk (10) is in associated with three secondary disks (20,30,40), whereas the depiction of FIGS. 8-10 show that the main disk (10) may be combined only with the first secondary disk (20), the second secondary disk (30) or the third secondary disk (40) respectively by inserting the respective connecting rod into the hollow cap (113).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A Ba-Gua fortune telling game tower comprising:

a main disk having a disk body with a top face divided into eight divinatory sections respectively designated with a Chinese character of Qian (乾), Dui (兌), Li(離), Zhen(震), Kun(坤), Gen (艮), Kan(坎) and Xun(巽), an inner annular groove defined in the top face and passing through each of the divinatory sections, an outer annular groove defined in an outer periphery of the top face of the disk body to sandwich the divinatory sections with the inner annular groove, a first ball being able to roll along the inner annular groove and randomly stopped at a position corresponding to one of the divinatory sections, a hollow cap formed on a center of the top face of the disk body and a transparent main dome a bottom periphery of which is received in the outer annular groove to isolate interference outside the transparent main dome to movement of the first ball; and a first secondary disk having a first secondary disk body with a top face divided into twelve portions respectively designated with a numeral from 1 to 6 such that there are two sets of numerals of 1 to 6 on the top face of the first secondary disk body, a first inner annular groove defined in the top face and passing through all the portions to allow a second ball to roll along the first inner annular groove and be randomly stopped at a position corresponding to one of the portions, a first connection rod centrally formed on the top face of the first secondary disk body to extend through a bottom face of the disk body of the main and a transparent first secondary cover mounted on the top face of the first secondary disk to prevent interference outside the first secondary disk from influencing movement of the second ball on the first inner annular groove such that from the positions of the first ball and the second ball, a player is able to look up information contained in a reference book to see the result of each time playing the game tower.

2. The game tower as claimed in claim 1, wherein the top face of the first secondary disk body further has a mediate annular groove sandwiching the portions with the first inner annular groove, the transparent first secondary cover is composed of an outer wall corresponding to and be received in a first outer annular groove, an inner wall corresponding to and be received in the mediate annular groove and an annular plate interconnecting a top periphery of the outer wall and of the inner wall to entirely isolate the movement of the second ball from interference outside the first secondary disk.

3. The game tower as claimed in claim 2, wherein a second secondary disk is provided to a bottom of the first secondary disk body and has a second secondary disk body with a top face divided into eighteen portions each designated with a numeral from 1 to 6 such that there are three sets of numerals from 1 to 6 on the top face of the second secondary disk body, a second inner annular groove defined in the top face of the second secondary disk body to allow annular groove defined in the top face of the second secondary disk body to allow a third ball to roll thereon and be randomly stopped at a position corresponding to one of the numerals on the top face of the second secondary disk body and a transparent second secondary cover mounted on top of the second secondary disk body to prevent interference outside the second secondary disk from influencing movement of the third ball on the second inner annular ring.

4. The game tower as claimed in claim 3, wherein a third secondary disk is provided to a bottom of the second secondary disk body and has a third secondary disk body with a top face divided into twenty-four portions each designated with a numeral from 1 to 6 such that there are four sets of numerals from 1 to 6 on the top face of the third secondary disk body, a third inner annular groove defined in the top face of the third secondary disk body to allow a fourth ball to roll thereon and be randomly stopped at a position corresponding to one of the numerals on the top face of the third secondary disk body and a transparent third secondary cover mounted on top of the third secondary disk body to prevent interference outside the third secondary disk from influencing movement of the fourth ball on the third inner annular ring.

5. A Ba-Gua fortune telling game tower comprising:

a main disk having a disk body with a top face divided into eight divinatory sections respectively designated with a Chinese character of Qian (乾), Dui (兌), Li(離), Zhen(震), Kun(坤), Gen (艮) Kan(坎) and Xun(巽), an inner annular groove defined in the top face and passing through each of the divinatory sections, an outer annular groove defined in an outer periphery of the top face of the disk body to sandwich the divinatory sections with the inner annular groove, a first ball being able to roll along the inner annular groove and randomly stopped at a position corresponding to one of the divinatory sections, a hollow cap formed on a center of the top face of the disk body and a transparent main dome a bottom periphery of which is received in the outer annular groove to isolate interference outside the transparent main dome to movement of the first ball; and a first secondary disk having a first secondary disk body with a top face divided into eighteen portions respectively designated with a numeral from 1 to 6 such that there are three sets of numerals of 1 to 6 on the top face of the first secondary disk body, a first inner annular groove defined in the top face and passing through all the portions to allow a second ball to roll along the first inner annular groove and be randomly stopped at a position corresponding to one of the portions, a first connection rod centrally formed on the top face of the first secondary disk body to extend through a bottom face of the disk body of the main disk and into the hollow cap to combine the first secondary disk and the main disk and a transparent first secondary cover mounted on the top face of the first secondary disk to prevent interference outside the first secondary disk from influencing movement of the second ball on the first inner annular groove such that from the positions of the first ball and the second ball, a player is able to look up information contained in a reference book to see the result of each time playing the game tower.

6. The game tower as claimed in claim 5, wherein a second secondary disk is provided to a bottom of the first secondary disk body and has a second secondary disk body with a top face divided into twenty-four portions each designated with a numeral from 1 to 6 such that there are four sets of numerals from 1 to 6 on the top face of the third secondary disk body, a second inner annular groove defined in the top face of the second secondary disk body to allow a second ball to roll thereon and be randomly stopped at a position corresponding to one of the numerals on the top face of the second secondary disk body and a transparent second secondary cover mounted on top of the second secondary disk body to prevent interference outside the second secondary disk from influencing movement of the second ball on the second inner annular ring.

7. A Ba-Gua fortune telling game tower comprising:

a main disk having a disk body with a top face divided into eight divinatory sections respectively designated with a Chinese character of Qian (乾), Dui (兌), Li(離), Zhen(震), Kun(坤), Gen(艮), Kan(坎) and Xun(巽), an inner annular groove defined in the top face and passing through each of the divinatory sections, an outer annular groove defined in an outer periphery of the top face of the disk body to sandwich the divinatory sections with the inner annular groove, a first ball being able to roll along the inner annular groove and randomly stopped at a position corresponding to one of the divinatory sections, a hollow cap formed on a center of the top face of the disk body and a transparent main dome a bottom periphery of which is received in the outer annular groove to isolate interference outside the transparent main dome to movement of the first ball; and a first secondary disk having a first secondary disk body with a top face divided into twenty-four portions respectively designated with a numeral from 1 to 6 such that there are four sets of numerals of 1 to 6 on the top face of the first secondary disk body, a first inner annular groove defined in the top face and passing through all the portions to allow a second ball to roll along the first inner annular groove and be randomly stopped at a position corresponding to one of the portions, a first connection rod centrally formed on the top face of the first secondary disk body to extend through a bottom face of the disk body of the main disk and into the hollow cap to combine the first secondary disk and the main disk and a transparent first secondary cover mounted on the top face of the first secondary disk to prevent interference outside the first secondary disk from influencing movement of the second ball on the first inner annular groove such that from the positions of the first ball and the second ball, a player is able to look up information contained in a reference book to see the result of each time playing the game tower.

* * * * *